US005232349A

United States Patent [19]

Kimura et al.

[11] Patent Number: 5,232,349

[45] Date of Patent: Aug. 3, 1993

[54] AXIAL MULTI-PISTON COMPRESSOR HAVING ROTARY VALVE FOR ALLOWING RESIDUAL PART OF COMPRESSED FLUID TO ESCAPE

[75] Inventors: Kazuya Kimura; Hiroaki Kayukawa; Toshiro Fujii, all of Kariya, Japan

[73] Assignee: Kabushiki Kaisha Toyoda Jidoshokki Seisakusho, Aichi, Japan

[21] Appl. No.: 941,681

[22] Filed: Sep. 8, 1992

[30] Foreign Application Priority Data

Sep. 1, 1991 [JP] Japan ..... 3-229166

[51] Int. Cl.[5] ..... F04B 1/26; F04B 27/08; F01B 3/00

[52] U.S. Cl. ..... 417/222.1; 417/269; 91/499

[58] Field of Search ..... 417/222.1, 222.2, 216, 417/218, 269, 271; 137/625.21, 625.22, 625.23; 91/499, 503

[56] References Cited

U.S. PATENT DOCUMENTS

| | | | |
|---|---|---|---|
| 3,696,710 | 10/1972 | Ortelli | 137/625.21 |
| 3,851,669 | 12/1974 | Zellbeck et al. | 137/625.21 |
| 4,061,443 | 12/1977 | Black et al. | 417/222.1 |
| 4,355,510 | 10/1982 | Ruseff | 417/222.1 |
| 4,379,389 | 4/1983 | Liesener | 417/216 |
| 4,872,814 | 10/1989 | Skimmer et al. | 417/222.2 |
| 5,011,377 | 4/1991 | Sagawa et al. | 91/499 |
| 5,081,908 | 1/1992 | McBeth et al. | 91/499 |

*Primary Examiner*—Richard A. Bertsch
*Assistant Examiner*—Alfred Basichas
*Attorney, Agent, or Firm*—Burgess, Ryan & Wayne

[57] ABSTRACT

An axial multi-piston compressor comprises a drive shaft, a cylinder block having cylinder bores formed therein and surrounding the drive shaft, and a plurality of pistons slidably received in the cylinder bores, respectively, wherein the pistons are successively reciprocated in the cylinder bores by a rotation of the drive shaft so that a suction stroke and a discharge stroke are alternately executed in each of the cylinder bores. During the suction stroke, a fluid is introduced into the cylinder bore, and during the compression stroke, the introduced fluid is compressed and discharged from the cylinder bore such that a residual part of the compressed fluid is inevitably left in the cylinder bore when the compression stroke is finished. The compressor further comprises a rotary valve for allowing the residual part of the compressed fluid to escape from the cylinder bore into another cylinder bore not governed by the compression stroke, whereby a pressure of the residual part of the compressed fluid can be lowered.

7 Claims, 7 Drawing Sheets

AXIAL MULTI-PISTON COMPRESSOR HAVING ROTARY VALVE FOR ALLOWING RESIDUAL PART OF COMPRESSED FLUID TO ESCAPE

BACKGROUND OF THE INVENTION

1) Field of the Invention

The present invention relates to an axial multi-piston compressor comprising a drive shaft, a cylinder block having cylinder bores formed therein and surrounding the drive shaft, and a plurality of pistons slidably received in the cylinder bores, respectively, wherein the pistons are successively reciprocated in the cylinder bores by a rotation of the drive shaft so that a suction stroke and a discharge stroke are alternately executed in each of the cylinder bores.

2) Description of the Related Art

Japanese Unexamined Patent Publication (Kokai) No. 59(1984)-145378 discloses a swash plate type compressor as representative of an axial multi-piston compressor, which may be incorporated in an air-conditioning system used in a vehicle such as an automobile. This swash plate type compressor comprises: front and rear cylinder blocks axially combined to form a swash plate chamber therebetween, the combined cylinder blocks having a same number of cylinder bores radially formed therein and arranged with respect to the central axis thereof, the cylinder bores of the front cylinder block being aligned and registered with the cylinder bores of the rear cylinder block, respectively, with the swash plate chamber intervening therebetween; double-headed pistons slidably received in the pairs of aligned cylinder bores, respectively; front and rear housings fixed to front and rear end faces of the combined cylinder blocks through the intermediary of front and rear valve plate assemblies, respectively, the front and rear housings each forming a suction chamber and a discharge chamber together with the corresponding one of the front and rear valve plate assemblies; a rotatable drive shaft arranged so as to be axially extended through the front housing and the combined cylinder blocks and a swash plate securely mounted on the drive shaft within the swash plate chamber and engaging with the double-headed pistons to cause these pistons to be reciprocated in the pairs of aligned cylinder bores, respectively, by the rotation of the swash plate.

The front and rear valve plate assemblies in particular have substantially the same construction, in that each comprises: a disc-like member having sets of a suction port and a discharge port each set being able to communicate with the corresponding one of the cylinder bores of the front or rear cylinder block; an inner valve sheet attached to the inner side surface of the disc-like member and having suction reed valve elements formed integrally therein, each of which is arranged so as to open and close the corresponding suction port of the disc-like member; and an outer valve sheet attached to the outer side surface of the disc-like member and having discharge reed valve elements formed integrally therein, each of which is arranged so as to open and close the corresponding discharge port of the disc-like member. Each of the front and rear valve plate assemblies is also provided with suction openings aligned with passages formed in the front or rear cylinder block, respectively, whereby the suction chambers formed by the front and rear housings are in communication with the swash plate chamber into which a fluid or refrigerant is introduced from an evaporator of an air-conditioning system, through a suitable inlet port formed in the combined cylinder blocks.

In the swash plate type compressor as mentioned above, the drive shaft is driven by the engine of a vehicle, such as an automobile, so that the swash plate is rotated within the swash plate chamber, and the rotational movement of the swash plate causes the double-headed pistons to be reciprocated in the pairs of aligned cylinder bores. When each piston is reciprocated in the aligned cylinder bores, a suction stroke is executed in one of the aligned cylinder bores and a compression stroke is executed in the other cylinder bore. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

When the compression stroke is finished, i.e., when the piston reaches top dead center, a small part of the compressed refrigerant is inevitably left in a fine space defined between the piston head and the valve plate assembly and in the discharge port formed in the valve plate assembly. Accordingly, when the piston is initially moved from the top dead center position toward bottom dead center, i.e., when the suction stroke is initiated, the refrigerant cannot be immediately introduced from the suction chamber into the cylinder bore through the suction reed valve element, because the residual part of the compressed refrigerant has a higher pressure than that of suction chamber. Namely, at the beginning of the suction stroke, the residual part of the compressed refrigerant is merely expanded in the cylinder bore, and thus the introduction of the refrigerant from the suction chamber into the cylinder bore cannot take place until the pressure of the residual part of the compressed refrigerant becomes lower than that of the suction chamber.

Therefore, in the conventional axial multi-piston compressor as mentioned above, a practical suction volume of the refrigerant, which can be obtained during the suction stroke, is lower than a theoretical suction volume thereof due to the residual part of the compressed refrigerant, and thus it is impossible to sufficiently realize out a theoretical performance from the conventional axial multi-piston compressor.

SUMMARY OF THE INVENTION

An object of the present invention is to provide an axial multi-piston compressor which is constituted such that a residual part of the compressed refrigerant escapes from the cylinder bore just before the suction stroke is initiated, whereby a practical suction volume of the refrigerant can be brought close to a theoretical suction volume as much as possible, so that a compression performance of the axial multi-piston compressor can be substantially improved.

In accordance with the present invention, there is provided an axial multi-piston compressor comprising: a drive shaft; a cylinder block having cylinder bores formed therein and surrounding the drive shaft; a plurality of pistons slidably received in the cylinder bores, respectively; a conversion means for converting a rotational movement of the drive shaft into a reciprocation of each piston in the corresponding cylinder bore such that a suction stroke and a discharge stroke are alternately executed therein, a fluid being introduced into the cylinder bore during the suction stroke, and during the compression stroke, the introduced fluid being compressed and discharged from the cylinder bore such that a residual part of the compressed fluid is inevitably left in the cylinder bore when the compression stroke is finished; and a valve means for allowing the residual part of the compressed fluid to escape from the cylinder bore into another cylinder bore not governed by the compression stroke, whereby a pressure of the residual part of the compressed fluid can be lowered.

The valve means may comprise a rotary valve joined to the drive shaft to be rotated together therewith and having a through passage formed therein, and during the rotation of the rotary valve, a communication between the cylinder bores is established by the through passage, whereby the residual part of the compressed fluid can escapes from one of the cylinder bores into the other cylinder bore.

Also, the valve means may comprise a rotary valve joined to the drive shaft to be rotated together therewith and having a closed loop groove formed in a peripheral surface thereof, and during the rotation of the rotary valve, a communication between the cylinder bores is established by the closed loop groove, whereby the residual part of the compressed fluid can escapes from one of the cylinder bores into the other cylinder bore.

Preferably, the rotary valve includes a passage means for introducing the fluid into each of the cylinder bores during the suction stroke.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
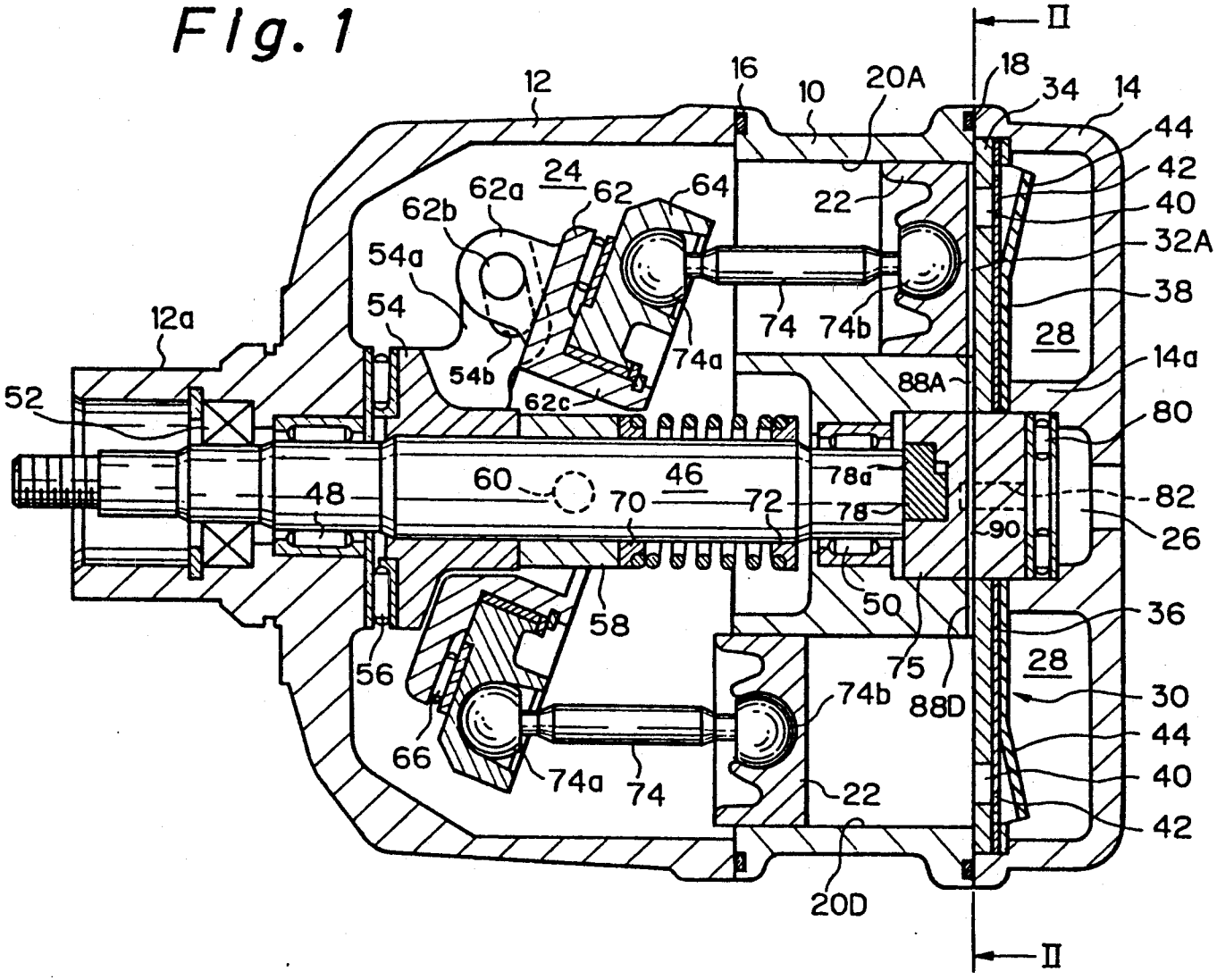
FIG. 1 is a longitudinal sectional view showing a wobble plate type compressor according to the present invention.
Figure 2:
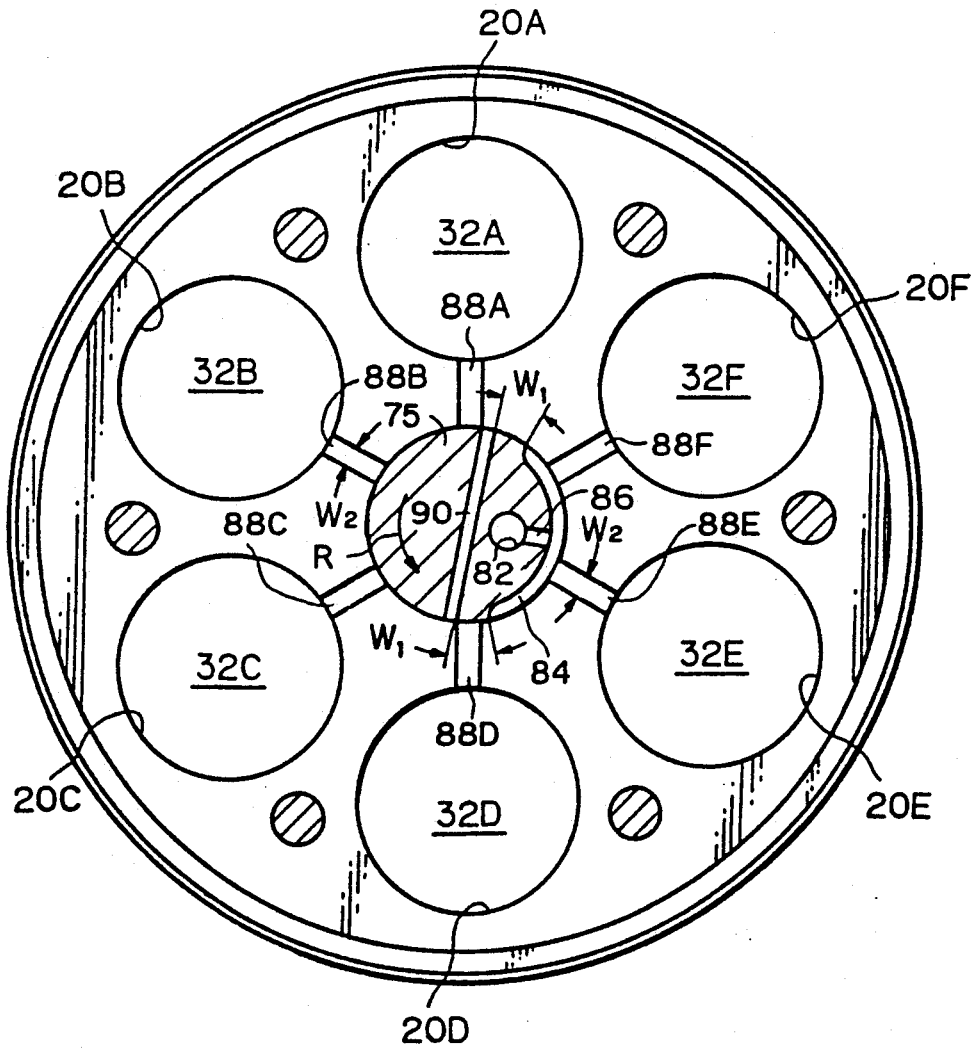
FIG. 2 is a cross-sectional view taken along a line II—II of FIG. 1.

FIG. 1 shows a wobble plate type compressor as an axial multi-piston compressor in which the present invention is embodied, and which may be used in an air-conditioning system (not shown) for a vehicle such as an automobile. The compressor comprises a cylinder block 10, front and rear housings 12 and 14 securely and hermetically joined to the cylinder block 10 at front and rear end faces thereof through the intermediary of O-ring rings 16 and 18, respectively. In this embodiment, as shown in FIG. 2, the cylinder block 10 has six cylinder bores 20A, 20B, 20C, 20D, 20E, and 20F formed radially and circumferentially therein and spaced from each other at regular intervals, and each of the cylinder bores slidably receives a piston 22. The front housing 12 has a crank chamber 24 defined therewithin, and the rear housing 14 has a central suction chamber 26 and an annular discharge chamber 28 defined therewithin and partitioned by an annular wall portion **14*a* integrally projected from an inner wall of the rear housing 14. In this embodiment, the suction chamber 26 and the discharge chamber 28** are in communication with an evaporator and a condenser of the air-conditioning system, respectively, so that a fluid or refrigerant is supplied from the evaporator to the suction chamber and a compressed refrigerant is delivered from the discharge chamber to the condenser.

A valve plate assembly 30 is disposed between the rear end face of the cylinder block 10 and the rear housing 14, and defines compression chambers 32A, 32B, 32C, 32D, 32E, and 32F together with the pistons 22 slidably received in the cylinder bores 20A to 20F, as shown in FIG. 2. The valve plate assembly 30 includes a disc-like plate member 34, a reed valve sheet 36 applied to an outer side surface of the disc-like plate member 34, and a retainer plate member 38 applied to an outer side surface of the reed valve sheet 36. The disc-like member may be made of a suitable metal material such as steel, and has six discharge ports 40 formed radially and circumferentially therein and spaced from each other at regular intervals, so that each of the discharge ports 40 is encompassed within an end opening area of the corresponding one of the cylinder bores 20A to 20F. The reed valve sheet 36 may be made of spring steel, phosphor bronze, or the like, and has six discharge reed valve elements formed integrally therewith and arranged radially and circumferentially to be in register with the discharge ports 40, respectively, whereby each of the discharge reed valve elements 42 can be moved so as to open and close the corresponding discharge port 40, due to a resilient property thereof. The retainer plate member 38 may be made of a suitable metal material such as steel, and is preferably coated with a very thin rubber layer. The retainer plate member 38 has six retainer elements 44 formed integrally therewith and arranged radially and circumferentially to be in register with the discharge reed valve elements 42, respectively. Each of the retainer elements 44 provides a sloped bearing surface for the corresponding one of the discharge reed valve elements 42, so that each discharge reed valve element 42 is opened only by a given angle defined by the sloped bearing surface.

A drive shaft 46 extends within the front housing 12 so that a rotational axis thereof matches a longitudinal axis of the front housing 12, and one end of the drive shaft 46 is projected outside from an opening formed in a neck portion **12*a* of the front housing 10 and is operatively connected to a prime mover of the vehicle for rotation of the drive shaft 46. The drive shaft 46 is rotatably supported by a first radial bearing 48 provided in the opening of the neck portion 12*a* and by a second radial bearing 50 provided in a central passage formed in the cylinder block 10. A rotary seal unit 52 is provided in the opening of the neck portion 12***a* to seal the crank chamber 24 from the outside.

A drive plate member 54 is mounted on the drive shaft 46 so as to be rotated together therewith, and a thrust bearing 56 is disposed between the drive plate member 54 and an inner side wall portion of the front housing 12. Also, a sleeve member 58 is slidably mounted on the drive shaft 46, and has a pair of pin elements 60 projected diametrically therefrom. Note, in FIG. 1, only one pin element 60 is illustrated by a broken line. A cam plate member 62 is swingably supported by the pair of pin elements 60. As being apparent from FIG. 1, the cam plate member 62 is in an annular form, and the drive shaft 46 extends through a central opening of the annular cam plate member 62. The drive plate member 54 is provided with an extension 54*a* having an elongated guide slot 54*b* formed therein, and the cam plate member 62 is provided with a bracket portion 62*a* projected integrally therefrom and having a guide pin element 62*b* received in the guide slot 54*b*, whereby the cam plate member 62 can be rotated together with the drive plate member 54, and is swingable about the pair of pin elements 60. A wobble plate member 64 is slidably mounted on an annular portion 62*c* projected integrally from the cam plate member 62, and a thrust bearing 66 is disposed between the cam plate member 62 and the wobble plate member 64.

The sleeve member 58 is always resiliently pressed against the drive plate member 54 by a compressed coil spring 68 mounted on the drive shaft 46. In particular, the compressed coil spring 68 is constrained between a movable ring element 70 slidably mounted on the drive shaft 46 and an immovable ring element 72 securely fixed on the drive shaft 46, and thus the sleeve member 58 is resiliently biased against the drive plate member 54.

To reciprocate the pistons 22 in the cylinder bores 20A to 20F, respectively, the wobble plate member 64 is operatively connected to the pistons 22 through the intermediary of six connecting rod 74 having spherical shoe elements 74*a* and 74*b* formed at ends thereof, and the spherical shoe elements 74*a* and 74*b* of each connecting rod 74 are slidably received in spherical recesses formed in the wobble plate member 64 and the corresponding piston 22, respectively. With this arrangement, when the cam plate member 62 is rotated by the drive shaft 46, the wobble plate member 64 is swung about the pair of pin elements 60, so that each of the pistons 22 are reciprocated in the corresponding cylinder bore 20A, 20B, 20C, 20D, 20E, 20F. The crank chamber 34 may be in communication with the suction chamber 26 and/or the discharge chamber through a suitable control valve (not shown) so that a pressure within the crank chamber is variable, whereby a stroke length of the pistons 22 is adjustable.

Figure 3:
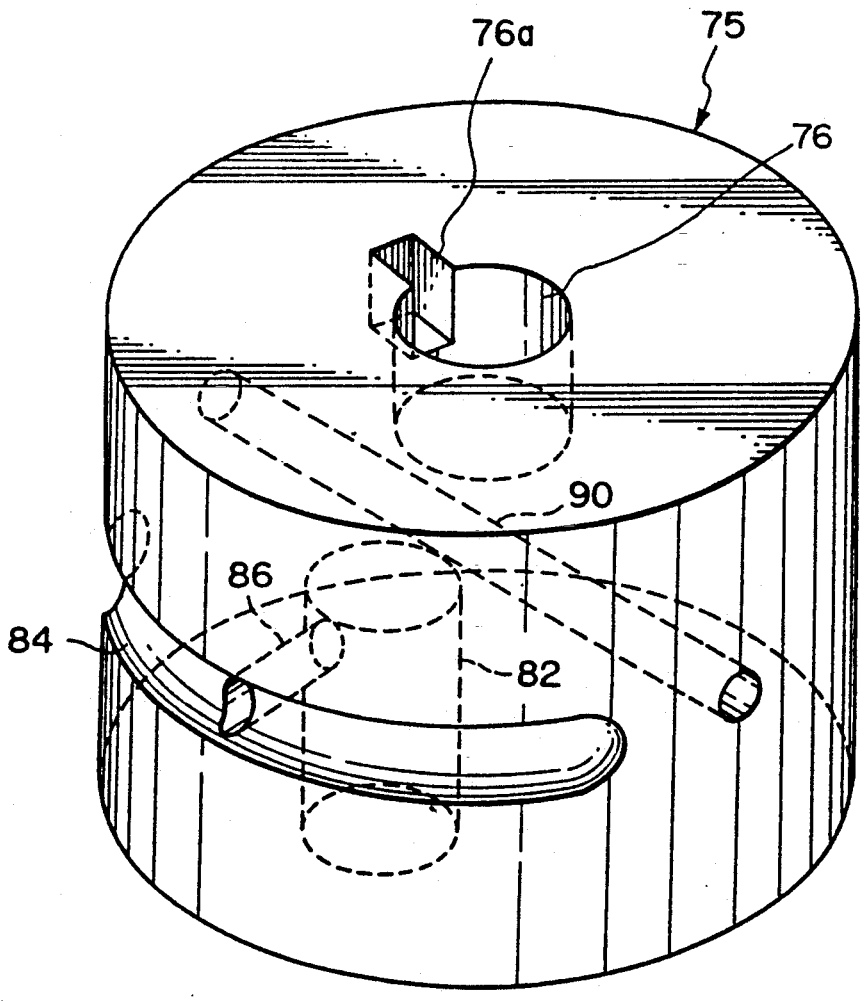
FIG. 3 is a perspective view of a rotary valve incorporated in the wobble plate type compressor shown in FIGS. 1 and 2.

As shown in FIG. 1, according to the present invention, a rotary valve 75 is slidably disposed in a circular space formed by a part of the central passage of the cylinder block 10, a central opening of the valve plate assembly 30, and a central recess partially defined by the annular wall portion 14*a* of the rear housing 14. The rotary valve 75 is coupled to the inner end of the drive shaft 46 so as to be rotated together therewith. To this end, the rotary valve 75 is provided with a central hole 78 formed in one end face thereof and having a key slot 76*a* extending radially therefrom, as best shown in FIG. 3, and the drive shaft 46 is provided with a stub element 78 projected from the inner end face thereof and having a key 78*a* extending radially therefrom, as shown in FIG. 1. Namely, the stub element 78 having the key 78*a* is inserted into the central hole 76 having the key slot 76*a*, so that the rotary valve 75 can be rotated together with the drive shaft 46. Note, in FIG. 1, a reference numeral 80 indicates a thrust bearing for the rotary valve 75, which is disposed in the central recess partially defined by the annular wall portion 14*a* of the rear housing 14.

The rotary valve 75 is also provided with a hole 82 formed in the other end face thereof, and an arcuate groove 84 formed in a peripheral surface thereof. The hole 82 opens at the suction chamber 26, and is in communication with the arcuate groove 84 through a radial passage 86 formed in the rotary valve 75, as best shown in FIG. 3. On the other hand, the cylinder block is provided with six radial grooves 88A, 88B, 88C, 88D, 88E, and 88F formed in the rear end face of the cylinder block 10 and extended from the compression chambers 32A to 32F to the central passage of the cylinder block 10, respectively, as shown in FIG. 2. When the rotary valve 75 is rotated in a direction indicated by an arrow R (FIG. 2), the radial grooves 88A to 88F successively communicate with the arcuate groove 84. Accordingly, during the rotation of the drive shaft 46, the refrigerant is successively introduced from the suction chamber 26 into the compression chambers 32A to 32F through the hole 82, the radial passage 86, and the arcuate groove 84.

The rotary valve 75 is further provided with a through passage 90 extending diametrically therethrough. During the rotation of the rotary valve 75, the two compression chambers 32A and 32D; 32B and 32E; 32C and 32F, which are diametrically disposed with respect to each other, are communicated with each other through the passage 90. As being apparent from FIG. 2, a distance ($W_1$) between a leading edge of the arcuate groove 84 and the corresponding open end of the passage 90 is equal to that ($W_1$) between a trailing edge of the arcuate groove 84 and the corresponding open end of the passage 90, and this distance ($W_1$) is larger than a width ($W_2$) of the radial grooves 88A to 88F. Accordingly, the passage 90 cannot be in communication with the arcuate groove 84 through each of the radial grooves 88A to 88F.

In operation, during the rotation of the drive shaft 46, the pistons 22 are reciprocated in the cylinder bores 20A to 20F, so that a suction stroke and a compression stroke are alternately executed in each of the cylinder bores 20A to 20F. During the suction stroke, i.e., during a movement of the piston 22 from top dead center toward bottom dead center, the refrigerant is introduced from the suction chamber 26 into the compression chamber 32A, 32B, 32C, 32D, 32E, 32F through the hole 82, the radial passage 86, and the arcuate groove 84. During the compression stroke, i.e., during a movement of the piston 22 from bottom dead center toward top dead center, the refrigerant is compressed in the compression chamber 32A, 32B, 32C, 32D, 32E, 32F, and is then discharged therefrom into the discharge chamber 28 through the corresponding reed valve 42.

When the compression stroke is finished in the cylinder bore 20A, 20B, 20C, 20D, 20E, 20F, i.e., when the piston 22 reaches top dead center, a part of the compressed refrigerant is inevitably left in a small volume of the compression chamber 32A, 32B, 32C, 32D, 32E, 32F defined by the valve plate assembly 30 and a head of the piston 22 moved to top dead center thereof, and in a volume of the discharge port 40 of the disc-like plate member 34. Nevertheless, according to the present invention, the residual part of the compressed refrigerant is eliminated from the compression chamber just before the suction stroke is initiated, as stated in detail hereinafter.

For example, when the rotary valve 75 is in an angular position as shown in FIG. 2, the piston 22 within the cylinder bore 20A is moved to a position just before it reaches top dead center (namely, just before the compression stroke is finished), whereas the piston 22 within the cylinder bore 20D is moved to a position just before it reaches bottom dead center (namely, just before the compression stroke is initiated). Note, each of the pistons 22 within the cylinder bores 20B and 20C are moved from bottom dead center toward top dead center (namely, during the course of the compression stroke), whereas each of the pistons 22 within the cylinder bores 20E and 20F are moved from top dead center toward bottom dead center (namely, during the course of the suction stroke). When the piston 22 within the cylinder bore 20A just reaches top dead center (namely, when the compression stroke is just finished), i.e., when the piston within the cylinder bore 20D just reaches bottom dead center (namely, when the compression stroke is just initiated), the compression chamber 32A is in communication with the compression chamber 32D through the passage 90, as shown in FIG. 1. Accordingly, the residual part of the compressed refrigerant escapes from the compression chamber 32A into the compression chamber 32D because a pressure of the residual part of the compressed refrigerant is higher than that of the refrigerant introduced into the compression chamber 32D. Thus, when the compression chamber 32A is communicated with the arcuate groove 84, i.e., when the suction stroke is initiated in the cylinder bore 20A, the refrigerant can be immediately introduced from the suction chamber 26 into the compression chamber 32A. Of course, this is also true for the other compression chambers 32B to 32F.

In the embodiment mentioned above, although the residual part of the compressed refrigerant escapes from the compression chamber (32A), in which the compression stroke is just finished, into the compression chamber (32D) in which the compression stroke is just initiated, the escape of the residual part of the compressed refrigerant can be carried out with respect to another compression chamber (32E, 32F) which is subjected to the suction stroke.

Figure 4:
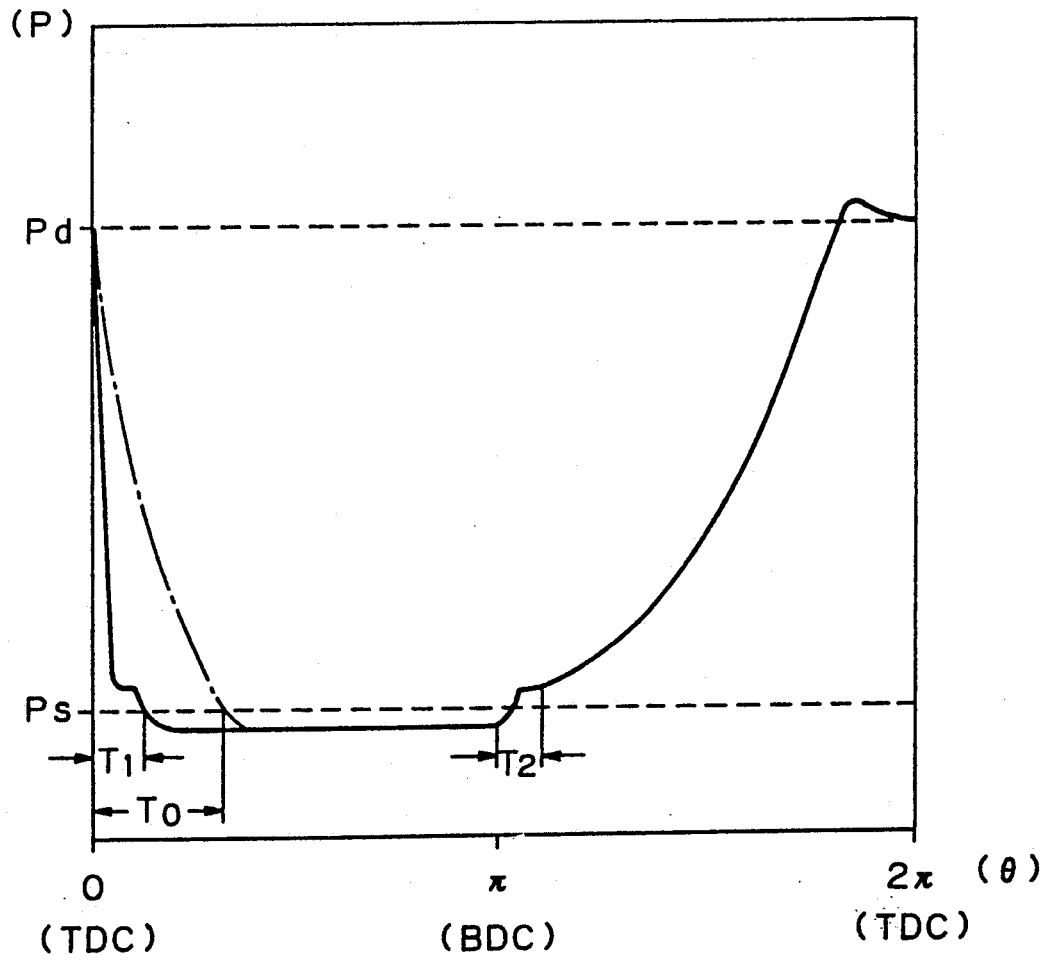
FIG. 4 is a graph showing a relationship between a pressure (P) of a compression chamber and a rotational angle ($\theta$) of the rotary valve.

FIG. 4 is a graph showing a relationship between a pressure (P) of the compression chamber and a rotational angle ($\theta$) of the rotary valve. In this graph, it is assumed that the rotational angle ($\theta$) of the rotary valve is zero when the piston concerned is at top dead center (TDC) thereof. For example, when the piston 22 within the cylinder bore 20A reaches top dead center thereof, the residual part of the compressed refrigerant is eliminated from the compression chamber 32A, as mentioned above, so that a discharging pressure ($P_d$) of the compression chamber 32A, at which the compressed refrigerant is discharged from the compression chamber 32A into the discharge chamber 28, is rapidly lowered to a suction pressure ($P_s$) at which the refrigerant is introduced from the suction chamber 26 into the compression chamber 32A, as indicated by a solid line in FIG. 4. Namely, it only takes a time $T_1$ until the pressure of the compression chamber 32A is lowered from $P_d$ to $P_s$. On the contrary, when a residual part of the compressed refrigerant is not eliminated from a compression chamber, i.e., when the suction reed valve is used, as stated hereinbefore, a pressure ($P_d$) of the residual part of the compressed refrigerant cannot be rapidly lowered to $P_s$, as indicated by a chain-dot line in FIG. 4. Namely, it takes a time $T_0$ until the pressure of the compression chamber is lowered from $P_d$ to $P_s$. Of course, the time $T_0$ is longer than the time of $T_1$ because an introduction of the refrigerant from the suction chamber into the compression chamber through the suction reed valve cannot take place until the residual part of the compressed refrigerant is expanded to thereby lower the pressure thereof to $P_s$.

When a cylinder bore has a cross-sectional area (S), and when a piston has a maximum length of stroke ($X_{max}$), a theoretical suction volume ($V_R$) is defined as follows:

$$V_R = SX_{max}$$

A practical suction volume ($V_1$) according to the present invention is defined as follows:

$$V_1 = S(X_{max} - X_1)$$

wherein $x_1$ indicates a travel length of the piston corresponding to the time $T_1$.

A practical suction volume ($V_0$) of the conventional case as mentioned above is defined as follows:

$$V_0 = S(X_{max} - x_0)$$

wherein $x_0$ indicates a travel length of the piston corresponding to the time $T_0$.

A ratio ($Q_1$) of the practical suction volume ($V_1$) to theoretical suction volume ($V_R$) is defined as follows:

$$Q_1 = V_1/V_R = (X_{max} - x_1)/X_{max}$$

Also, a ratio ($Q_0$) of the practical suction volume ($V_0$) to theoretical suction volume ($V_R$) is defined as follows:

$$Q_0 = V_0/V_R = (X_{max} - x_0)/X_{max}$$

Therefore, a compression performance of an axial multi-piston compressor according to the present invention can be improved by a difference ($\Delta Q$) defined as follows:

$$\Delta Q = Q_1 - Q_0 = (x_0 - x_1)/X_{max}$$

Note, when the rotary valve is rotated by a rotational angle of $\pi$, as shown in the graph of FIG. 4, so that the piston 22 within the cylinder bore 20A is moved from top dead center (TDC) to bottom dead center (BDC), a pressure of the compression chamber 32A is somewhat raised over a time $T_2$. Of course, this is because the compression chamber 32A is supplied with a residual part of the compressed refrigerant from the compression chamber 32D in which the compression stroke is just finished.

Figure 5:
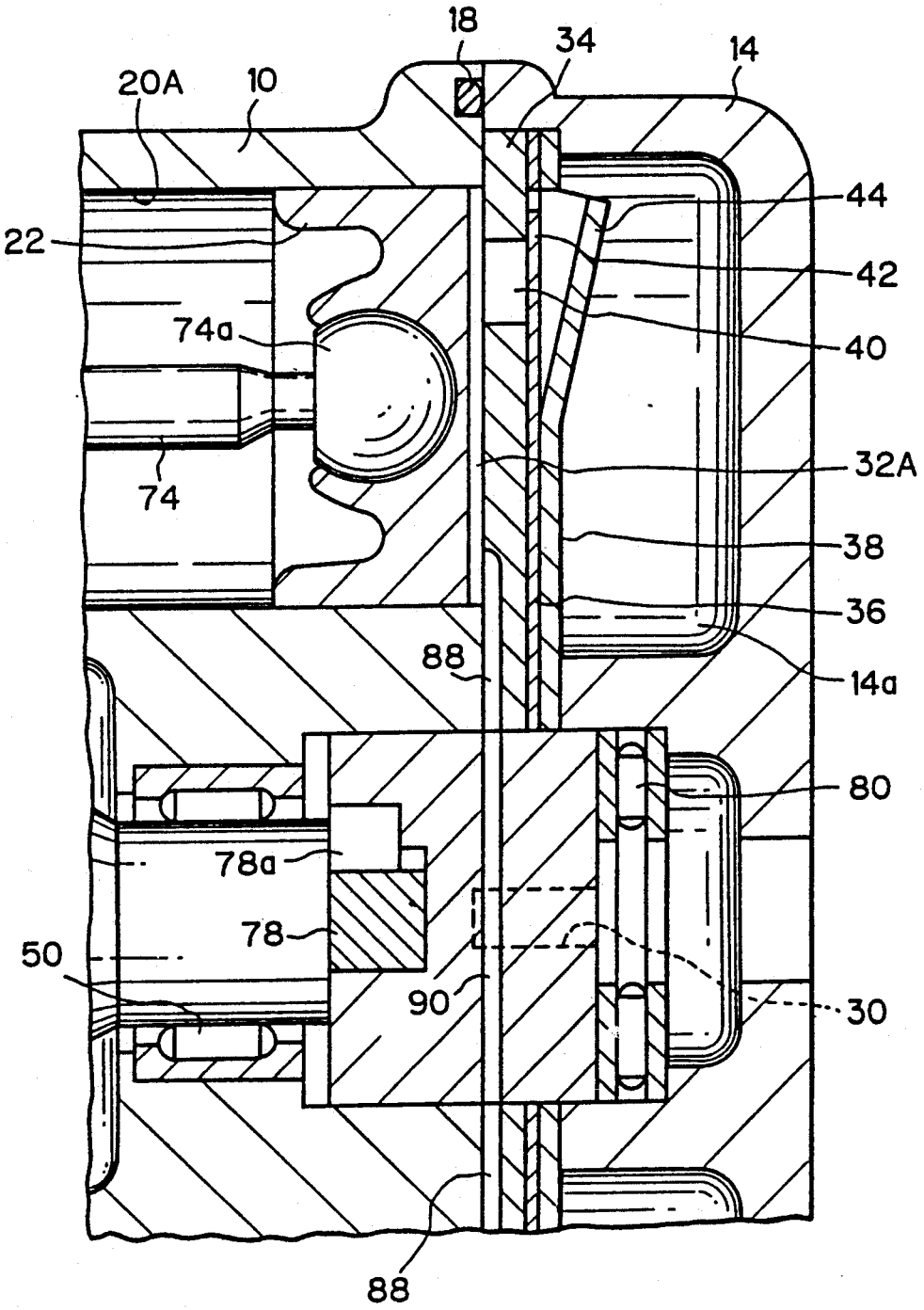
FIG. 5 is a partial longitudinal sectional view showing a modification of the wobble plate type compressor shown in FIG. 1.

FIG. 5 shows a modification of the embodiment as shown in FIGS. 1 to 3. This modified embodiment is identical to the embodiment of FIGS. 1 to 3 except that six radial grooves 88 corresponding to the radial grooves 88A to 88F are formed in the disc-like plate member 34 of the valve plate assembly 30.

Figure 6:
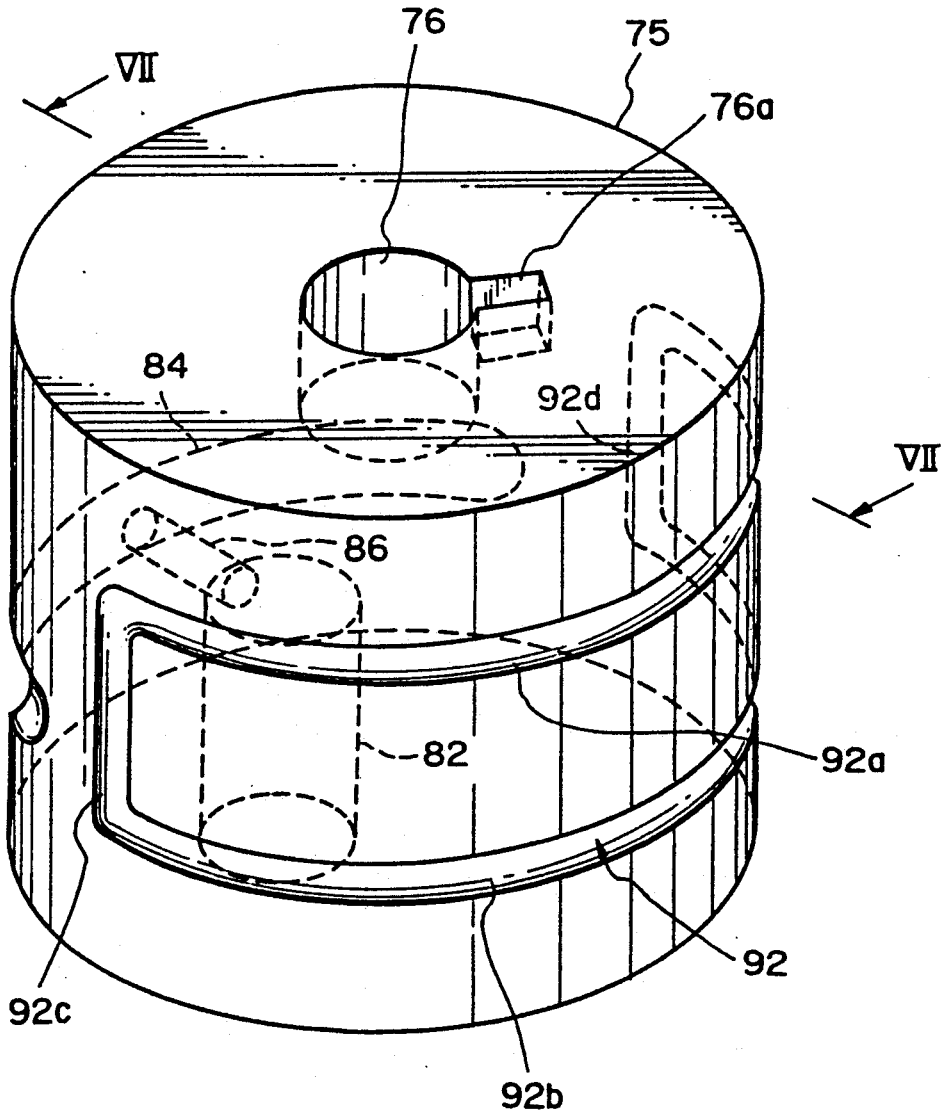
FIG. 6 is a perspective view showing a modification of the rotary valve shown in FIG. 3.
Figure 7:
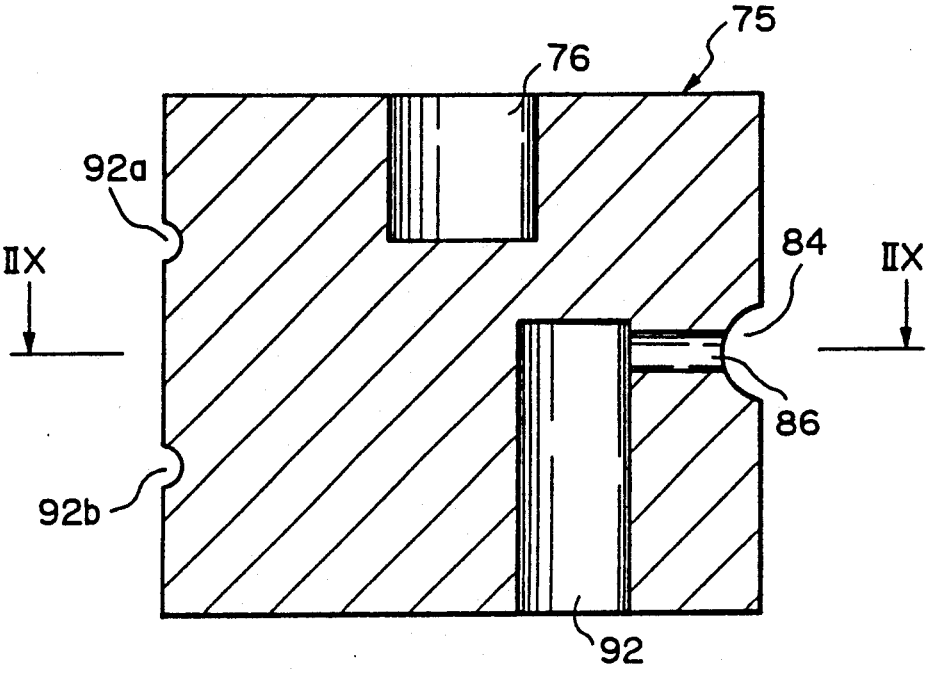
FIG. 7 is a longitudinal view taken along a line VII—VII of FIG. 6.
Figure 8:
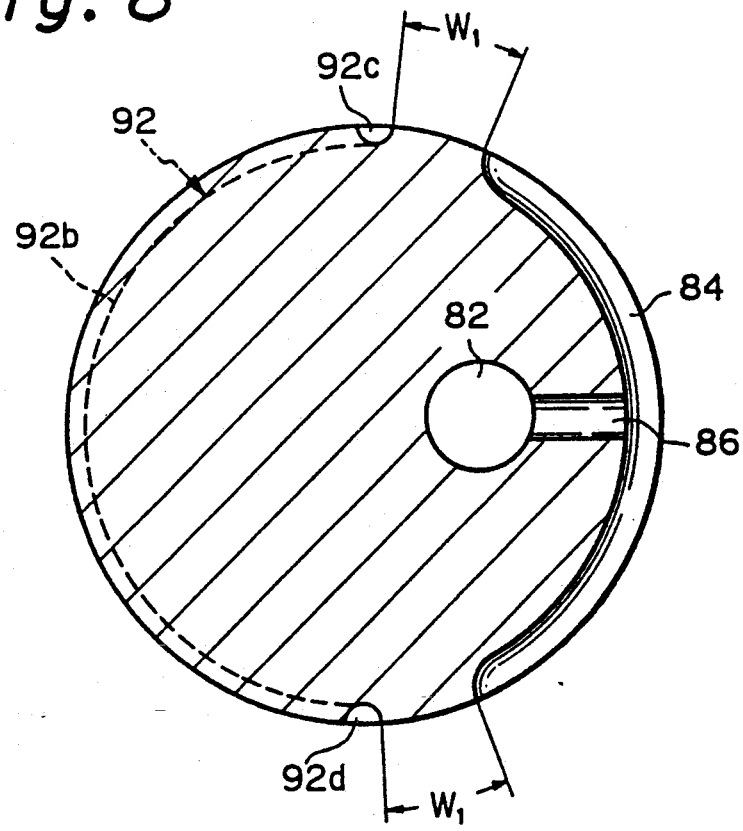
FIG. 8 is a cross-sectional view taken along line IIX—IIX of FIG. 7.

FIGS. 6, 7 and 8 show a modification of the rotary valve 75 as shown in FIGS. 1 to 3. In this modified rotary valve 75', a closed loop groove 92 is formed in the peripheral surface thereof in place of the through passage 90, and includes two parallel arcuate groove portions 92*a* and 92*b* coextended circumferentially along the outer peripheral surface of the rotary valve 75', and two side groove portions 92*c* and 92*d* connected between two sets of edges of the parallel arcuate groove portions 92*a* and 92*b*. As best shown in FIG. 8, the side groove portions 92*c* and 92*d* are diametrically disposed so as to be simultaneously in communication with the two diametrically disposed radial grooves 88A; 88D, 88B; 88E, 88C; 88F, respectively, so that the diametrically disposed compression chambers 32A; 32D, 32B; 32E, 32C; 32F are in communication with each other when the compression stroke is finished. Also, a distance ($W_1$) between one of the side groove portions 92*c* and 92*d* and the corresponding edge of the arcuate groove 84 adjacent thereto is larger than the width ($W_2$) of the radial grooves 88A to 88F, and thus the side groove portion 92*c*, 92*d* cannot be in communication with the arcuate groove 84 through each of the radial grooves 88A to 88F. Thus, the modified rotary valve 75' can be substituted for the rotary valve 75. Note, during the rotation of the rotary valve 25, an inner end of each of the radial grooves 88A to 88F is in seal engagement with an inner surface area defined by the closed loop groove 92.

In the embodiments described, although the refrigerant is introduced from the suction chamber 26 into the compression chamber 32A, 32B, 32C, 32D, 32E, 32F through the intermediary of the rotary valve 75, 75', the introduction of the refrigerant into the compression chamber through a reed valve may be performed, as disclosed in the above-mentioned Publication (Kokai) No. 59(1984)-145378. In this case, the rotary valve having only either the through passage 90 or the closed loop groove 92 is incorporated in the compressor, whereby the residual part of the compressed refrigerant can escapes from the compression chamber when the compression stroke is finished.

Also, in the embodiments described, although the present invention is applied to a wobble plate type compressor as an axial multi-piston compressor, the present invention may be embodied in another type axial multi-piston compressor.

Finally, it will be understood by those skilled in the art that the foregoing description is of preferred embodiments of the disclosed compressor, and that various changes and modifications may be made to the present invention without departing from the spirit and scope thereof.

We claim:

1. An axial multi-piston compressor comprising:

a drive shaft;

a cylinder block having cylinder bores formed therein and surrounding said the drive shaft;

a plurality of pistons slidably received in the cylinder bores, respectively;

a conversion means for converting a rotational movement of said drive shaft into a reciprocation of each piston in the corresponding cylinder bore such that a suction stroke and a discharge stroke are alternately executed therein, a fluid being introduced into said cylinder bore during the suction stroke, and during the compression stroke, the introduced fluid being compressed and discharged from said cylinder bore such that a residual part of the compressed fluid is inevitably left in said cylinder bore when the compression stroke is finished; and a valve means for allowing the residual part of the compressed fluid to escape from said cylinder bore into another cylinder bore not governed by the compression stroke, whereby a pressure of the residual part of the compressed fluid can be lowered.

2. An axial multi-piston compressor as set forth in claim 1, wherein said valve means comprises a rotary valve joined to said drive shaft to be rotated together therewith and having a through passage formed therein, and during the rotation of said rotary valve, a communication between the cylinder bores is established by said through passage, whereby the residual part of the compressed fluid can escape from one of said cylinder bores into the other cylinder bore.

3. An axial multi-piston compressor as set forth in claim 2, wherein said rotary valve includes a passage means for introducing the fluid into each of the cylinder bores during the suction stroke.

4. An axial multi-piston compressor as set forth in claim 1, wherein said valve means comprises a rotary valve joined to said drive shaft to be rotated together therewith and having a groove formed in a peripheral surface thereof, and during the rotation of said rotary valve, a communication between the cylinder bores is established by said groove, whereby the residual part of the compressed fluid can escape from one of said cylinder bores into the other cylinder bore.

5. An axial multi-piston compressor as set forth in claim 4, wherein said groove is in the form of a closed loop.

6. An axial multi-piston compressor as set forth in claim 4, wherein said rotary valve includes a passage means for introducing the fluid into each of the cylinder bores during the suction stroke.

7. An axial multi-piston compressor as set forth in claim 6, wherein said groove and said passage means are diametrically opposed to each other on the peripheral surface of said rotary valve.

* * * * *